US006427333B1

(12) United States Patent
Veltz et al.

(10) Patent No.: US 6,427,333 B1
(45) Date of Patent: Aug. 6, 2002

(54) KNIFE-AND-SHEATH COMBINATION WITH POSITIVE KNIFE-TO-SHEATH LOCK AND MULTIPLE ATTACHMENTS POINTS

(75) Inventors: Jason D. Veltz, LaJolla; Stephen J. Hull, San Diego; William H. Keys, El Cajon; Edward Gillet, San Diego, all of CA (US)

(73) Assignee: Buck Knives, Inc., El Cajon, CA (US)

( * ) Notice: Subject to any disclaimer, the term of this patent is extended or adjusted under 35 U.S.C. 154(b) by 0 days.

(21) Appl. No.: 09/483,307

(22) Filed: Jan. 14, 2000

(51) Int. Cl.[7] ..... B26B 29/02
(52) U.S. Cl. ..... 30/158; 30/151; 30/162
(58) Field of Search ..... 30/158, 162, 163, 30/151

(56) References Cited

U.S. PATENT DOCUMENTS 4,389,776 A * 6/1983 Okada ..... 30/162
4,414,744 A * 11/1983 Collins ..... 30/151
4,558,516 A * 12/1985 Collins ..... 30/151
5,255,436 A * 10/1993 Yoshida ..... 30/151
5,297,341 A * 3/1994 Collins ..... 30/162
5,379,520 A * 1/1995 Collins ..... 30/162
5,511,310 A * 4/1996 Sessions et al. ..... 30/161
5,621,973 A * 4/1997 Seber et al. ..... 30/161
5,647,130 A * 7/1997 Collins ..... 30/151
5,964,035 A * 10/1999 Poehlmann ..... 30/161
6,138,363 A * 10/2000 Kawashima ..... 30/151

* cited by examiner

*Primary Examiner*—M. Rachuba
*Assistant Examiner*—Kim Ngoc Tran
(74) *Attorney, Agent, or Firm*—Gregory Garmong

(57) ABSTRACT

A knife-and-sheath combination includes a knife with a blade having two opposing broad faces and an opening through the blade extending between the broad faces, and a handle extending from the blade. The combination also includes a sheath including a sheath body having a receptacle sized to receive the blade therein, and a positive lock operable to lock the knife to the sheath. The positive lock includes a locking element engagable to the opening in the blade of the knife, and a lock release accessible to a user of the knife-and-sheath combination, the lock release being operable to disengage the locking element from the opening in the blade of the knife.

16 Claims, 2 Drawing Sheets

KNIFE-AND-SHEATH COMBINATION WITH POSITIVE KNIFE-TO-SHEATH LOCK AND MULTIPLE ATTACHMENTS POINTS

This invention relates to a knife-and-sheath combination wherein the knife and sheath cooperate for improved security of carrying and convenience of use.

BACKGROUND OF THE INVENTION

Knives serve as important tools for persons in active outdoor pursuits. A knife is used to cut objects, and can also serve other functions depending upon features built into the knife. Fixed-blade knives are typically stronger and may be put into service more quickly than folding knives, while folding knives often have a wider variety of features available.

The usefulness of the knife is related to its availability and ease of use, as well as its functionality. The knife must not be easily lost, either when stored or when used. The knife must be easily reached and retrieved from its storage location. It must also be easily returned to and retained in its storage location when it is not immediately required. The knife must be storable in a convenient fashion. The knife must not cut objects or the user when stored, when it is retrieved, and when it is returned to storage. Knife storage is typically accomplished using a sheath for fixed-blade knives, and a pouch or a clip for folding knives.

The present invention deals with a fixed-blade knife and its storage sheath. Some storage sheaths for fixed blade knives have retaining straps which hold the knife in place in the sheath for storage with a positive lock between the sheath and the knife so that the knife may not be lost from the sheath. Other sheaths serve a distinctly different detent function, which retains the knife in the sheath by friction or other easily overcome force. For extremely active pursuits, a detent-type sheath is not acceptable, because the knife may be jarred loose from the sheath and lost. In these cases, only a positive-lock type sheath is sufficient.

When the knife having a positive-lock sheath is to be used, the strap is released and the user withdraws the knife from the sheath. After use, the knife is returned to the sheath, and the user must reconnect the strap. Except for specialized, symmetric stiletto knives and their sheaths which have limited use in active pursuits, the knife must be returned to the sheath in a specific orientation in order for the strap to be reconnected. These restrictions limit the usefulness of the sheath and the knife in these activities.

Additionally, knife-and-sheath combinations used in active pursuits must be easily attached to other structure, such as a piece of apparatus or to the user. The knife and sheath must be retained securely in that position.

There is a need for a more convenient knife-and-sheath combination for use in active situations where there is a substantial chance of the knife being lost if it is not positively locked to the sheath and if the sheath itself is not secured to its support. The present invention fulfills this need, and further provides related advantages.

SUMMARY OF THE INVENTION

The present invention provides a knife and a sheath which, when used in combination, provide convenient storage and availability of the knife. The knife is retained in the sheath with a positive lock, as distinct from a detent. The knife may be released from the positive lock with the sheath and removed from the sheath using one hand, and returned to and locked in the sheath in either a left-hand or right-hand configuration. The sheath itself is configured for reliable, sound attachment to either the body of the user or to objects. Multiple types of attachments are provided, as may be required for a variety of situations.

In accordance with the invention, a knife-and-sheath combination comprises a knife and a sheath. The knife comprises a blade having two opposing broad faces and an opening through the blade extending between the broad faces, and a handle extending from the blade. The sheath comprises a sheath body having a receptacle sized to receive the blade therein, and a positive lock operable to lock the knife to the sheath. The positive lock includes a locking element engagable to the opening in the blade of the knife, and a lock release accessible to a user of the knife-and-sheath combination. The lock release is operable to disengage the locking element from the opening in the blade of the knife.

In one embodiment, the locking element comprises a pin having a hexagonal cross section, and the pin is oriented perpendicular to the broad faces of the knife, when the knife is received within the receptacle. The opening in the blade of the knife may have a segment comprising a side of a hexagon disposed to engage the pin when the knife blade is received within the sheath body. The locking element engages the opening with a positive lock, not a frictional detent. The knife cannot be disengaged from the sheath in expected conditions of moderate or strenuous activities without actuation of the lock release.

Desirably, the knife blade may be inserted into the sheath receptacle in either a left-handed or a right-handed orientation. In this case, the opening in the blade of the knife is disposed so that the locking element may engage the opening in the blade of the knife whether the knife is inserted into the sheath in the left-handed or the right-handed orientation.

The sheath body may be described as having a broad face. In one embodiment, the lock release comprises a flap on a face of the sheath body, wherein the flap is hinged to the broad face of the sheath, and wherein the locking element is engaged to the flap. There is a lip on an end of the flap which extends outwardly from the end of the flap, so that the user of the knife and sheath may release the lock with thumb pressure on the lip that forces the flap outwardly to withdraw the pin locking element from the opening of the knife.

Typically, the sheath further includes an elongated sheath support extending from the sheath body so that the handle of the knife is adjacent to the sheath support when the knife blade is inserted into the receptacle. The sheath support is preferably made of fabric such as webbing material. The sheath support may have a first attachment ring at a distal end thereof remote from the sheath body. A second attachment ring may be affixed to the sheath body at an end thereof remote from the first attachment ring. The second attachment ring may be movable between a retracted position and an extended position, preferably by a pivoting movement between the retracted position and the extended position. The two attachment rings allow the sheath to be affixed to objects from attachments at both ends of the sheath.

The sheath preferably has the sheath receptacle on a front side of the sheath body and has an open end for receiving the knife blade therein. The sheath further includes a clip affixed to the sheath at a location remote from the open end and extending toward the open end. The clip is on a back side of the sheath body opposite to the front side. The clip allows the sheath to be clipped to an object in the inverted position, with the knife handle extending downwardly.

The present approach provides a knife-and-sheath combination in which the knife is positively locked to the sheath for storage, except when it is intentionally released. The knife may be inserted into the sheath in either a left-hand or a right-hand orientation, with the positive lock operable in either orientation. The sheath may be secured to the user or to objects. These features impart a high degree of reliability and security to the use of the knife and the sheath, as well as convenience. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
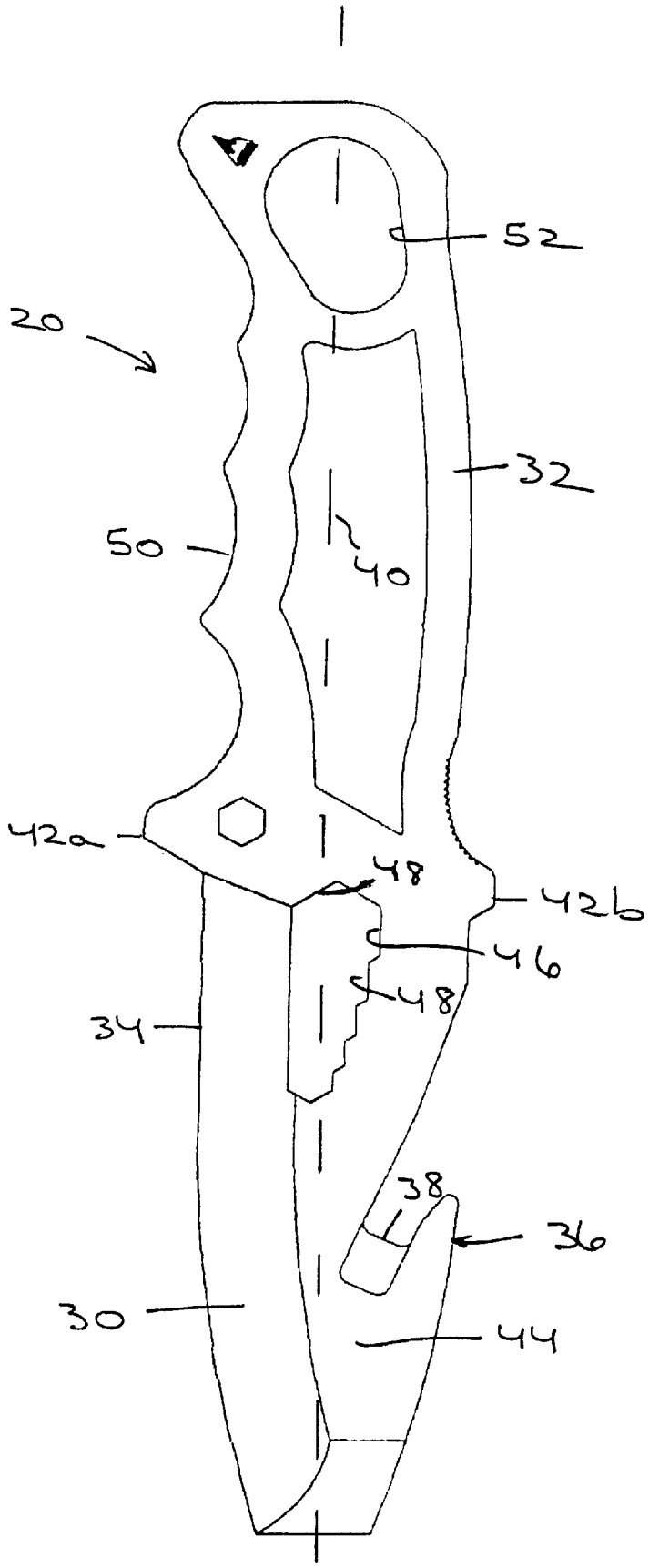
FIG. 1 is a front elevational view of a knife.

FIG. 1 illustrates a knife 20 and FIGS. 2–6 illustrate a sheath 22 that is operable with the knife 20.

The knife 20 of FIG. 1 is a fixed-blade knife having a knife blade 30 and a handle 32 extending from the blade 30. The knife blade 30 has a sharpened blade edge 34 and an unsharpened back 36. The depicted embodiment of the knife 20 further has a fabric- or rope-cutting recessed cutter 38 in the back 36, such as that described in U.S. Pat. No. 5,485,677. Because of the oppositely disposed blade edge 34 and back 36, the knife 20 is not symmetric about a longitudinal centerline 40, which is a line parallel to a direction of elongation of the knife 20 and equidistant between the furthest transverse extremities 42*a* and 42*b* of the knife 20. This asymmetry is intentional, so that the user of the knife may distinguish by hand feel between the orientation where the blade edge of the knife is to be used and the orientation where the back 36 or the cutter 38 on the back is to be used. The illustrated preferred embodiment of the knife 20 is specifically designed for active water sports, and the ability to distinguish between the two orientations may become important if the knife user is trapped underwater and needs to quickly select between the appropriate knife orientations required to escape.

The knife blade 30 has two opposing and generally parallel broad faces 44. One broad face 44 is visible in FIG. 1, and the other broad face is obscured on the opposite side of the knife blade 30. There is an opening 46 through the knife blade 30 extending between the two broad faces 44. The opening 46 is positioned near to or on the centerline 40, preferably so that the centerline 40 passes through the opening 46. In this case, the opening 46 is structured to provide a number of hexagonal side segments 48 that may be used as hex wrenches of different sizes, providing the user of the knife with the ability to loosen and tighten nuts or bolts.

The illustrated embodiment of the knife has a skeleton handle 32 with finger holds 50 and a lanyard opening 52. In this embodiment, the handle 32 is integral with the blade 30, and both are made of 17-7 PH stainless steel. A karabiner or lanyard (not illustrated) may be passed through the lanyard opening 52 to secure the knife to an object or to the user of the knife.

The sheath 22, illustrated in FIGS. 2–6, includes a sheath body 60 made of a suitable material, in this case polyethylene plastic. The sheath body 60 has a front side 62 and a back side 64. The sheath body 60 is formed of two facing-but-spaced apart sheets of material that are joined along three sides, with a receptacle 66 defined therebetween and an open end 88 along one edge. The receptacle 66 is sized to receive the knife blade 30 therein, and typically extends for most of the length of the interior of the sheath body 60. The sheath 22 is thus elongated parallel to a longitudinal centerline 69 of the sheath 22

An elongated sheath support 68 extends from the sheath body 60 in a direction parallel to the longitudinal centerline 69 of the sheath. The sheath support 68 is affixed to the sheath body 60 by any operable approach, preferably rivets. The sheath support 68 is preferably made of a fabric web material. Two arms 70*a* and 70*b* extend from a back side of the sheath support 68 and include a closure 71, preferably a hook-and-loop closure, at a joining location 72. This arrangement permits the sheath support 68 to be conveniently affixed to a belt of a user of the knife 20 or to a horizontal structure. An optional strap 74 extends transversely to the sheath body 60 at about the location where the sheath support 68 joins to the sheath body 60. The strap 74 has a closure 76, preferably a hook-and-loop closure, on its ends so that it may be secured around the knife handle 32 when the knife blade 30 is inserted into the receptacle 66, if desired.

A first attachment ring 78 is affixed to a distal end of the sheath support 68 at a location remote from the sheath body 60. The first attachment ring 78 is preferably of the type known generally as a D-ring. A second attachment ring 80 is affixed to the sheath body 60 at a bottom end 82 thereof. The second attachment ring 80 is movable between a retracted position illustrated in FIG. 2 and an extended position in which the second attachment ring 80 extends downwardly from the sheath body 60 relative to the view of FIG. 2, but not illustrated in FIG. 2. The second attachment ring 80 is rotated to the extended position when it is to be used to secure an attachment, and rotated to the retracted position when it is not needed, so that it is out of the way and does not interfere with the user of the knife and sheath. The movement between the retracted and extended positions is preferably accomplished by a pivoting action of the second attachment ring 80 about an axis lying in the plane of FIG. 2 and perpendicular to the longitudinal centerline 69, so that the pivoting action is out of the plane of the drawing of FIG. 2. To accomplish this pivoting action, the second attachment ring 80 is in the general form of two of the three sides of a triangle, with a pivot pin 84 extending inwardly from each of these sides. The pivot pins 84 are received into cooperatively positioned pivot recesses 86 in the bottom end 82 of the sheath body 60, which pivot recesses 86 are shown in phantom view in FIG. 2.

The sheath receptacle 66 is on the front side 62 of the sheath body 60 and has the open end 88 for receiving the knife blade 30. A clip 90 is affixed to the sheath body 60 at an attachment location 92 remote from the open end 88 of the receptacle 66. The clip 90 extends from the attachment location 92 toward the open end 88, but the clip 90 is on the back side 64 of the sheath body 60 opposite to the front side 62. The clip 90 allows the sheath 22 to be clipped to an external support in an upside-down orientation with the open end 88 facing downwardly. This clip 90 is sized to clip the sheath 22 in an upside-down orientation to an attachment patch found on life vests, so that the knife and sheath may be used by users engaging in active water sports such as kayaking. The positive lock between the knife and the sheath prevents the knife 20 from falling out of the sheath 22 when the sheath 22 is in this upside-down orientation.

Figure 2:
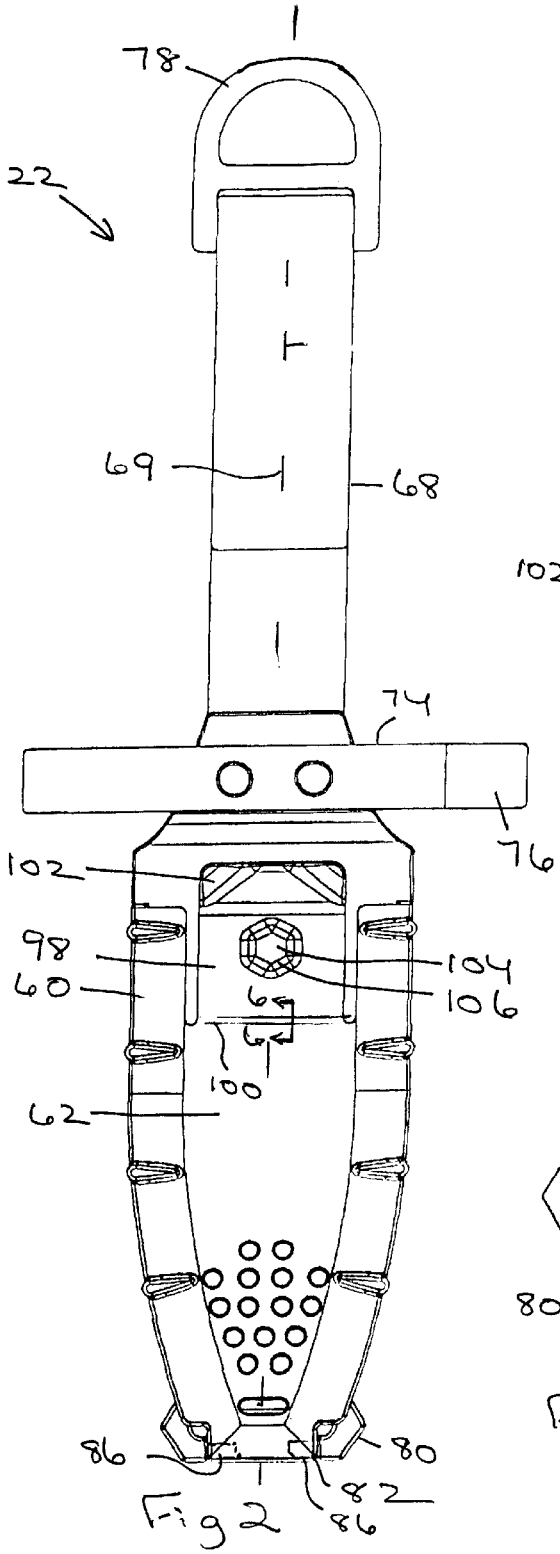
FIG. 2 is a front elevational view of a preferred embodiment of a sheath operable with the knife of FIG. 1.
Figure 6:
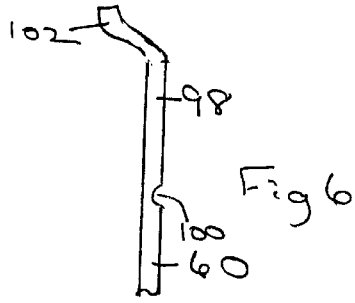
FIG. 6 is an enlarged schematic sectional view of a detail of the sheath, taken along line 6—6 of FIG. 2.
Figure 4:
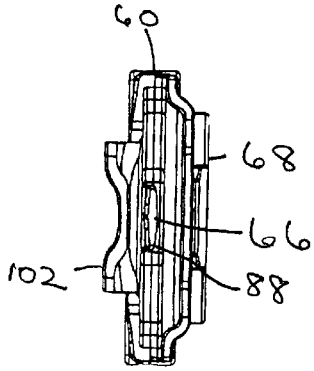
FIG. 4 is a top end elevational view of the sheath of FIG. 2.
Figure 5:
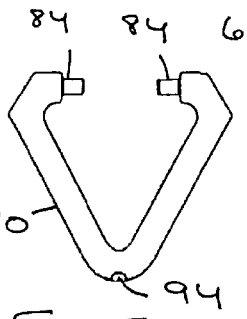
FIG. 5 is an elevational view of the second attachment ring.
Figure 3:
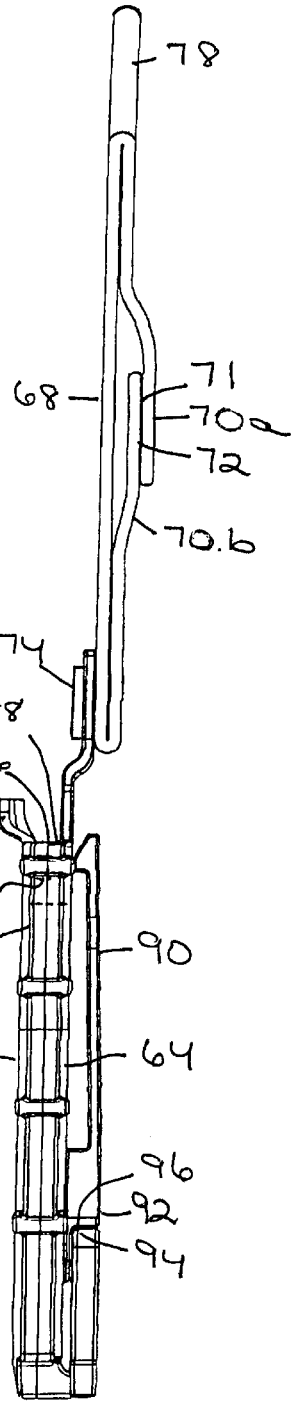
FIG. 3 is a side elevational view of the sheath of FIG. 2.

When the second attachment ring 80 is pivoted to the retracted position as shown in FIG. 2, a detent recess 94 on the second attachment ring 80 engages to a corresponding protrusion 96 positioned at the attachment location 92. The engagement of the protrusion 96 to the detent recess 94 frictionally retains the second attachment ring 80 in the retracted position until the user of the knife manually forces the detent out of engagement so that the second attachment ring 80 may be rotated to the extended position.

When the knife blade 30 is inserted into the receptacle 66 of the sheath body 60, the knife 20 is locked to the sheath 22 with a positive lock. A positive lock is distinguished from a detent in that the positive lock has a blocking engagement of the elements to be locked and requires an unlocking action, such as by the lifting or releasing of a lock mechanism, while the detent requires only the overcoming of friction and a slight deformation.

The positive lock between the knife 20 and the sheath 22 is preferably achieved with a locking element on the sheath body 60 which engages to the opening 46 of the knife blade 30 when the knife blade 30 is inserted fully into the receptacle 66 of the sheath body 60. The locking element, when engaged to the opening 46, blocks the movement of the knife blade 30 out of the sheath body 60. The positive lock is released by the manual operation by the user of a lock release accessible to the user. The lock release is operable to disengage the locking element from the opening 46 in the blade 30 of the knife 20.

In the illustrated preferred embodiment, the locking element and lock release include an integral flap 98 on the front side 62 of the sheath body 60. The flap 98 is hinged to the sheath body 60 by a live hinge 100 which is shown in more detail in FIG. 6. The live hinge 100 includes a cutout or relief in the material from which the sheath body 60 and the integral flap 98 are formed, extending transversely along the length of the hinge 100. The material of construction of the sheath body 60 and the flap 98 preferentially bends at this cutout, defining the hinge 100 that allows the flap 98 to bend. A lip 102 extends outwardly from the flap 98 away from the receptacle 66 so as to be manually accessible to the hand of the user of the knife and sheath. When the lip 102 is pressed outwardly, as by the thumb of the user, the flap 98 bends outwardly at the hinge 100.

A pin 104 extends through the flap 98 in a direction perpendicular to the back side 94 of the sheath body 60 and also to the broad faces 44 of the knife blade 30 when the knife blade 30 is inserted into the receptacle 66 of the sheath body 60. The pin 104 is securely anchored to the material of the flap 98. The pin 104 is positioned so as to engage and pass through the opening 46 of the knife blade 30 when the knife blade is fully inserted into the receptacle 66. The pin 104 may be disengaged from the opening 46 by pressing the lip 102 outwardly away from the back side 64 of the sheath body. The knife 20 is simultaneously withdrawn from the receptacle 66. For the preferred case where the opening 46 has the hexagonal side segments 48, the pin 104 desirably has hexagonal sides 106 to engage a correspondingly sized hexagonal side segment 48 of the opening 46.

Locking of the knife 20 to the sheath 22 is automatically accomplished by sliding the knife blade 30 into the receptacle 66. As insertion occurs, the end of the pin 104 rides upwardly over the broad face 44 of the knife blade 30 and the flap 98 is bent slightly outwardly. When the opening 46 reaches the pin 104, the restoring force created at the hinge 100 of the flap 98 causes the pin 104 to fall into the opening 46, locking the knife blade 30 to the sheath body 60. At a later time, the user removes the knife 20 from the sheath 22 by pressing the lip 102 outwardly to bend the flap 98 outwardly and disengage the pin 102 from the opening 46. Simultaneously, the user withdraws the knife 20 from the sheath 22. This combination of movements is readily accomplished with one hand.

An important feature of the knife-and-sheath combination is that the knife blade 30 may be inserted into, locked into, unlocked from, and withdrawn from the sheath body 60 with the knife oriented in either a left-hand or a right-hand orientation. If a left-hand orientation is defined as the orientation pictured in FIG. 1 with the blade edge 34 pointed toward the left-hand side of the drawing, then a right-hand orientation is obtained by rotating the knife 20 about the centerline 40 until the blade edge 34 points toward the right-hand side of the drawing. The knife 20 may be used in either orientation with the sheath 22 positioned as in FIG. 2. This feature allows the sheath to be positioned at the most convenient location for either a left-handed or a right-handed person, or at the most convenient location in cramped or other difficult circumstances. The user need not be concerned with orienting the knife in a particular manner in order to achieve the locking action. Absent this feature, the user might insert the knife into the receptacle in a stressful time without paying attention to the orientation of the knife and under the belief that the knife will lock to the sheath, when in fact the knife was misoriented such that the lock did not function and the knife could fall out of the sheath. The result could be the loss of the knife.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A knife-and-sheath combination, comprising:

a knife comprising a blade having two opposing broad faces and an opening through the blade extending between the broad faces, and a handle extending from the blade; and a sheath comprising a sheath body having a receptacle sized to receive the blade therein, a positive lock operable to lock the knife to the sheath, the positive lock including a locking element engagable to the opening in the blade of the knife, and a lock release accessible to a user of the knife-and-sheath combination, the lock release being operable to disengage the locking element from the opening in the blade of the knife.

2. The knife-and-sheath combination of claim 1, wherein the locking element comprises a pin having a hexagonal cross section, the pin being oriented perpendicular to the broad faces of the knife, when the knife is received within the receptacle.

3. The knife-and-sheath combination of claim 2, wherein the opening in the blade of the knife has a segment comprising a side of a hexagon disposed to engage a hexagonal side of the hexagonal cross section of the pin when the knife blade is received within the sheath body.

4. The knife-and-sheath combination of claim 1, wherein the knife blade may be inserted into the sheath receptacle in either a left-handed or a right-handed orientation, and wherein the opening in the blade of the knife is disposed so that the locking element may engage the opening in the blade of the knife whether the knife is inserted into the sheath in the left-handed or the right-handed orientation.

5. The knife-and-sheath combination of claim 1, wherein the sheath body has a broad face, and wherein the lock release comprises a flap on a face of the sheath body, wherein the flap is hinged to the broad face of the sheath, and wherein the locking element is engaged to the flap, and a lip on an end of the flap, the lip extending outwardly from the end of the flap.

6. The knife-and-sheath combination of claim 1, further including an elongated sheath support extending from the sheath body so that the handle of the knife is adjacent to the sheath support when the knife blade is inserted into the receptacle.

7. The knife-and-sheath combination of claim 6, wherein the sheath support is made of fabric.

8. The knife-and-sheath combination of claim 6, wherein the sheath support has a first attachment ring at a distal end thereof remote from the sheath body.

9. The knife-and-sheath combination of claim 8, further including a second attachment ring affixed to the sheath body at an end thereof remote from the first attachment ring, the second attachment ring being movable between a retracted position and an extended position.

10. The knife-and-sheath combination of claim 9, wherein the second attachment ring is pivotable between the retracted position and the extended position.

11. The knife-and-sheath combination of claim 1, wherein the sheath receptacle is on a front side of the sheath body and has an open end for receiving the knife blade therein, and wherein the sheath further includes a clip affixed to the sheath body at a location remote from the open end and extending toward the open end, the clip being on a back side of the sheath body opposite to the front side.

12. The knife-and-sheath combination of claim 1, wherein the locking element comprises a pin, the pin being oriented perpendicular to the broad faces of the knife, when the knife is received within the receptacle.

13. A knife-and-sheath combination, comprising:

a knife comprising a blade having two opposing broad faces, and a handle extending from the blade; and a sheath comprising a sheath body having a receptacle sized to receive the blade therein, an elongated sheath support extending from the sheath body so that the handle of the knife is adjacent to the sheath support when the knife blade is inserted into the receptacle, a first attachment ring affixed to a distal end of the sheath support remote from the sheath body, and a second attachment ring affixed to the sheath body at an end thereof remote from the first attachment ring, the second attachment ring being movable between a retracted position and an extended position.

14. The knife-and-sheath combination of claim 13, wherein the second attachment ring is pivotable between the retracted position and the extended position.

15. The knife-and-sheath combination of claim 13, wherein the sheath receptacle is on a front side of the sheath body and has an open end for receiving the knife blade therein, and wherein the sheath further includes a clip affixed to the knife sheath at a location remote from the open end and extending toward the open end, the clip being on a back side of the sheath body opposite to the front side.

16. The knife-and-sheath combination of claim 13, wherein the sheath support is made of fabric.

* * * * *